United States Patent [19]

Drori

[11] 4,002,295

[45] Jan. 11, 1977

[54] SELF-REGULATING SPRINKLER

[76] Inventor: Mordeki Drori, 89 Zahal St., Kiron, Israel

[22] Filed: Feb. 17, 1976

[21] Appl. No.: 658,608

[30] Foreign Application Priority Data

Feb. 19, 1975 Israel ..... 46669

[52] U.S. Cl. ..... 239/230; 138/46; 239/570

[51] Int. Cl.[2] ..... B05B 3/02

[58] Field of Search ..... 239/230, 231, 232, 233, 239/570; 138/44, 45, 46

[56] References Cited

UNITED STATES PATENTS

| | | | |
|---|---|---|---|
| 1,998,592 | 4/1935 | Schenk | 230/230 X |
| 3,669,356 | 6/1972 | Senninger | 239/230 |

*Primary Examiner*—John J. Love
*Assistant Examiner*—Michael Mar
*Attorney, Agent, or Firm*—Benjamin J. Barish

[57] ABSTRACT

A pressure-regulated water sprinkler comprises a sprinkler head carrying a nozzle at one end through which the water discharges in the form of a jet. The sprinkler head includes a housing defining an internal chamber communicating at one end with the nozzle and having an inlet at another end. The nozzle end of the housing is formed with a plurality of internal ribs spaced circumferentially and extending longitudinally to a point within the chamber intermediate the nozzle and inlet ends. The ribs are formed with a first annular shoulder adjacent to the nozzle end of the chamber, and with a second annular shoulder more remote from the nozzle end and of larger diameter than the first annular shoulder. An annular ring within the chamber has one side bearing against the second annular shoulder and its opposite side facing the housing inlet. A regulator member is movable between the ring and the first annular shoulder; and a pressure sensor is provided for sensing the inlet pressure and automatically moving the regulator member towards and away from the annular ring to regulate the flow therethrough to the nozzle.

7 Claims, 1 Drawing Figure

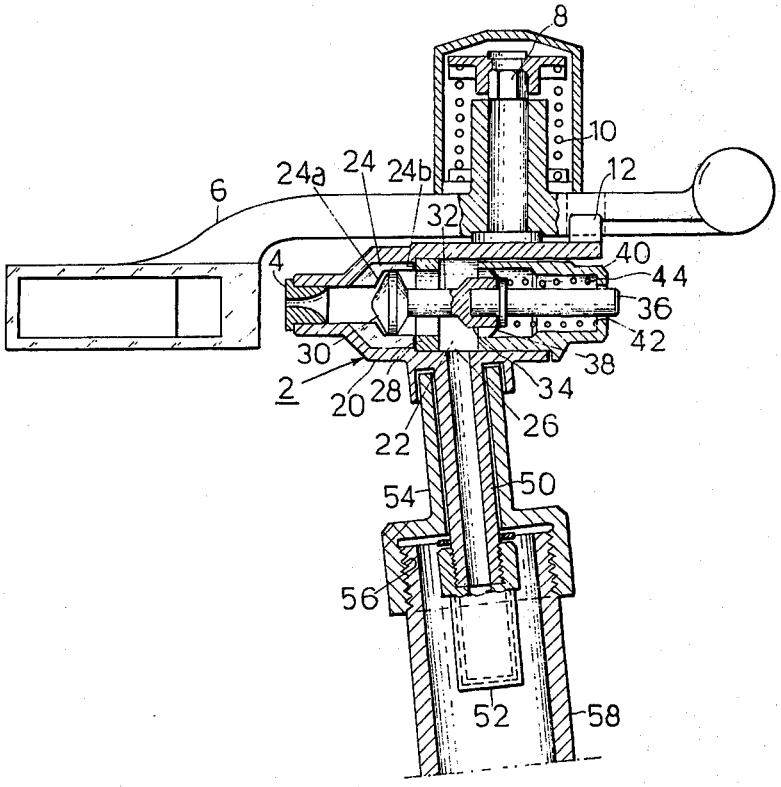
8
10
12
6
24a
24
24b
32
40
4
44
36
42
30
38
2
20
28
34
22
26
54
50
56
52
58

SELF-REGULATING SPRINKLER

BACKGROUND OF THE INVENTION

The present invention relates to self-regulating water sprinklers, and particularly to the known type including a regulator member which is displaced in response to pressure changes to regulate the flow through the sprinkler nozzle.

An object of the present invention is to provide an improved construction of sprinkler of this type which enables it to be produced and assembled at low cost.

SUMMARY OF THE INVENTION

According to the present invention, there is provided a pressure-regulated water sprinkler including a sprinkler head carrying a nozzle at one end through which the water discharges in the form of a jet, characterized in that the sprinkler head includes a housing defining an internal chamber communicating at one end with the nozzle and having an inlet at another end; the nozzle end of the housing being formed with a plurality of internal ribs spaced circumferentially and extending longitudinally to a point within the chamber intermediate the nozzle and inlet ends; said ribs being formed with a first annular shoulder adjacent to the nozzle end of the chamber, and with a second annular shoulder more remote from the nozzle end and of larger diameter than the first annular shoulder; an annular ring fixedly disposed within the chamber and having one side bearing against said second annular shoulder and its opposite side facing the housing inlet; a regulator member movably disposed within the chamber between said ring and first annular shoulder; and pressure-sensing means for sensing the inlet pressure and automatically moving the regulator member towards and away from said one side of the annular ring to regulate the flow therethrough to the nozzle.

According to another feature, the pressure-sensing means comprises a first rod passing through said ring and carrying said regulator disc at one end, and a piston at its opposite end; a second rod fastened at one end to the piston of the first rod, the opposite end of the second rod passing through a further opening in the sprinkler head housing; a seal disposed between the joined ends of the two rods; and a spring interposed between the housing and the end of the first rod joined to the second rod.

A sprinkler of the foregoing type can be constructed of a few simple parts which can be quickly assembled together or disassembled for inspection or maintenance purposes. Further features and advantages of the invention will be apparent from the description below.

BRIEF DESCRIPTION OF THE DRAWING

The invention is herein described, by way of example only, with respect to a preferred embodiment illustrated in the single FIGURE of accompanying drawings showing, in longitudinal section, a sprinkler constructed in accordance with the present invention.

DESCRIPTION OF THE PREFERRED EMBODIMENT

The sprinkler illustrated in the drawings includes a head, generally designated 2, formed at one end with a nozzle 4 through which the water is discharged in the form of a jet, the jet impinging an oscillating arm 6 pivotably mounted about a pin 8 carried by the sprinkler head. Oscillating arm 6 is urged into position to be impinged by the water issuing from nozzle 4 by means of a spring 10, and as the arm is impinged by the water jet, it is driven to load the spring during the forward stroke of the arm, the energy stored in the spring causing the arm to return in the return stroke and to engage an abutment 12 carried by the sprinkler head. This impacting of the arm against abutment 12 causes the sprinkler head to rotate about its vertical axis.

The sprinkler head 2 includes a housing 20 defining an internal chamber 22, one end of the chamber being closed by nozzle 4. The latter is in the form of an apertured member or plug press-fitted into that end of chamber 22.

The nozzle end of chamber 22 is formed with a plurality of internal ribs 24 spaced circumferentially from each other and extending longitudinally to a point within chamber 22 intermediate nozzle 4 and inlet 26 of the chamber. Ribs 24 are formed with a first annular shoulder **24*a* adjacent to the nozzle 4 end of the chamber, and with a second annular shoulder 24*b* more remote from the nozzle end and of a larger diameter than the first annular shoulder 24*a*. An annular ring 28 of plastic or the like is press-fitted against annular shoulder 24*b* of the ribs. The internal diameter of the ring is substantially equal to the internal diameter of the annular shoulder 24*b* defined by this end of the ribs. The opposite side of ring 28 faces inlet 26**.

Regulator disc 30 is movably disposed within chamber 22 between ring 28 and annular shoulder **24*a*. This disc is movable, in response to the pressure of the water at the inlet 26, towards and away from the annular ring 28 so as to regulate the flow of the water passing from the inlet through the annular ring and to the nozzle 4**.

Disc 30 is carried at one end of a rod 32, the opposite end of the rod being formed as a piston 34. A second rod 36 is press-fitted into the piston end of rod 32. A sealing ring 38 is interposed between and is securely held by the two rods 32 and 36. A closure member 40 having an opening 42 at one end is press-fitted into the sprinkler housing 20. A spring 44 is interposed between the inner end of rod 36 and closure member 40, spring 44 biassing rod 36, and thereby disc 30, towards the nozzle 4 end of the sprinkler head.

The inlet 26 to the housing 20 is formed integrally with a conduit 50 which has a filter 52 attached to its lower end. A sleeve 54 encloses the conduit 50, the lower end of the sleeve being threaded, as shown at 56, for attachment to a water supply pipe 58.

The self-regulating sprinkler illustrated in the drawings operates substantially as in the known type, in that if there is an increase in water pressure at inlet 26, the force applied against piston 34 of rod 32 is increased, tending to move disc 30 towards ring 28, thereby restricting the flow of the water able to pass through the ring to the nozzle. However, the illustrated sprinkler can be manufactured at very low cost because of its few and simple parts that can be inexpensively produced by injection moulding and conveniently assembled by hand.

What is claimed is:

1. A pressure-regulated water sprinkler including a sprinkler head carrying a nozzle at one end through which the water discharges in the form of a jet, characterized in that the sprinkler head includes a housing defining an internal chamber communicating at one end with the nozzle and having an inlet at another end; the nozzle end of the housing being formed with a plurality of internal ribs spaced circumferentially and extending longitudinally to a point within the chamber intermediate the nozzle and inlet ends; said ribs being formed with a first annular shoulder adjacent to the nozzle end of the chamber, and with a second annular shoulder more remote from the nozzle end and of larger diameter than the first annular shoulder; an annular ring fixedly disposed within the chamber and having one side bearing against said second annular shoulder and its opposite side facing the housing inlet; a regulator member movably disposed within the chamber between said ring and first annular shoulder; and pressure-sensing means for sensing the inlet pressure and automatically moving the regulator member towards and away from said one side of the annular ring to regulate the flow therethrough to the nozzle.

2. A water sprinkler according to claim 1, wherein said regulator member is a disc.

3. A water sprinkler, according to claim 2, wherein said pressure-sensing means comprises a first rod passing through said ring and carrying said regulator disc at one end, and a piston at its opposite end; a second rod fastened at one end to the piston of the first rod, the opposite end of the second rod passing through a further opening in the sprinkler head housing; a seal disposed between the joined ends of the two rods; and a spring interposed between the housing and the end of the first rod joined to the second rod.

4. A sprinkler according to claim 3, wherein said further opening in the housing is defined by an apertured closure-member press-fitted into one end of the housing.

5. A sprinkler according to claim 1, wherein said nozzle is constituted of an apertured member press-fitted into the nozzle end of the housing.

6. A sprinkler according to claim 1, wherein it further includes a spring-biassed oscillating arm pivotably mounted on a pin formed integrally with the housing, said oscillating arm including a central embossment and a sleeve press-fitted onto the central embossment, the spring biassing the arm being attached at one end to a cap fixed to the pin, and at the opposite end to the central embossment of the arm, said sprinkler head including an abutment engageable by the oscillating arm for rotating the sprinkler head about a vertical axis.

7. A sprinkler according to claim 1, wherein said inlet end of the sprinkler housing is formed with an integral conduit and includes a filter attached at one end of the conduit, the sprinkler housing further including a sleeve enclosing said conduit and threaded at its lower end for attachment to a water supply pipe.

* * * * *